US006220198B1

(12) United States Patent
Bruce

(10) Patent No.: US 6,220,198 B1
(45) Date of Patent: Apr. 24, 2001

(54) MARINE ANCHORS

(75) Inventor: Peter Bruce, Douglas (GB)

(73) Assignee: Brupat Limited, Cronkbourne-Douglas (GB)

( * ) Notice: Subject to any disclaimer, the term of this patent is extended or adjusted under 35 U.S.C. 154(b) by 0 days.

(21) Appl. No.: 09/429,153

(22) Filed: Oct. 28, 1999

Related U.S. Application Data

(63) Continuation of application No. PCT/GB95/01089, filed on Apr. 30, 1997.

(51) Int. Cl.[7] ..... B63B 21/32

(52) U.S. Cl. ..... 114/301; 21/32

(58) Field of Search ..... 114/294, 301, 114/304, 310, 299, 293

(56) References Cited

U.S. PATENT DOCUMENTS

| | | | |
|---|---|---|---|
| 3,508,513 | 4/1970 | Ilfrey et al. . | |
| 3,754,524 | 8/1973 | Locks . | |
| 4,793,276 | 12/1988 | Stafford . | |
| 5,474,015 * | 12/1995 | Bruce | 114/294 |

* cited by examiner

*Primary Examiner*—Jesus D. Sotelo
(74) *Attorney, Agent, or Firm*—Arnold & Associates

(57) ABSTRACT

A marine anchoring device (1, 33) for penetration into a sea bed is having at least part of its external surface in the form of a low friction surface (8, 12, 13, 14). The device can comprise (a) a drag embedment anchor (1) or alternatively (b) a direct embedment anchor (1A). The low friction surface can be formed by a low friction coating which is adhered to the external surface of the device, or by a coating which is smeared onto the external surface. A lubricant supply apparatus (16, 19) can be provided to replenish the lubricant lost by the friction action of the soil.

41 Claims, 3 Drawing Sheets

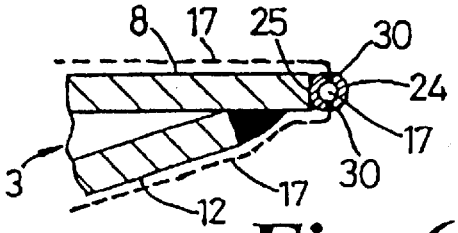
Fig. 6
Fig. 7
Fig. 5
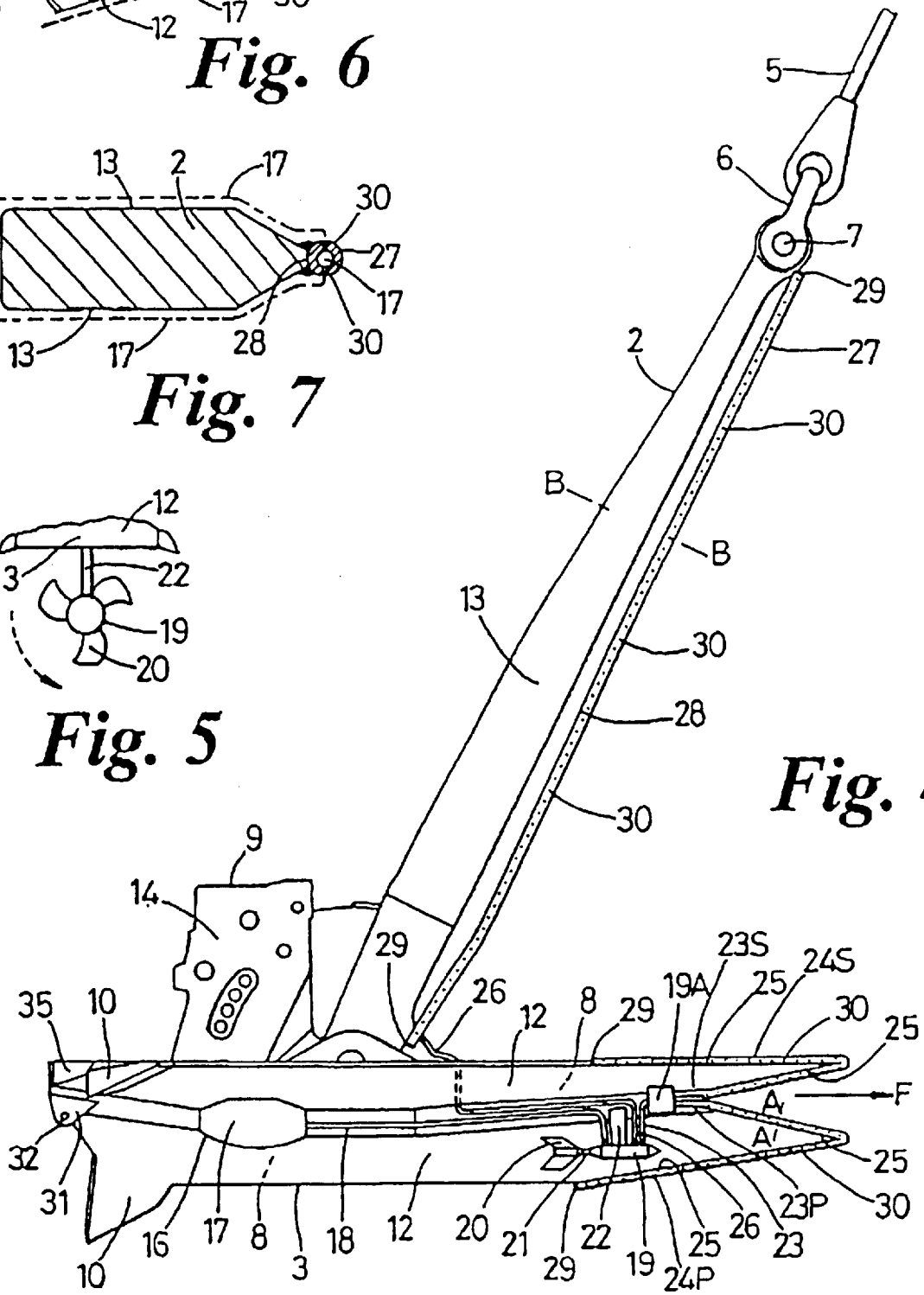
Fig. 4

MARINE ANCHORS

This application is a continuation of PCT/GB95/01089 filed Apr. 30, 1997.

The present invention relates to embedment marine anchors and their embedment means and, in particular to anchors of the types disclosed in International Patent Application PCT/NL92/001144 (published as WO93/03958) and in the present applicants International Patent Application PCT/GB96/01756 (published as WO96/39324).

Embedment marine anchors, embedded by drag embedment means or by direct embedment means, are generally attached to an anchor line for connection to an object to be moored or restrained in a body of water over a mooring bed.

A drag embedment anchor is embedded by pulling (dragging) the anchor horizontally over the mooring bed by use of embedment means comprising an anchor line to cause penetration both horizontally and vertically along a curved embedment trajectory in the mooring bed soil. The drag embedment anchor comprises a planar or curved plate-like or blade-like fluke member and a shank means attached to the fluke member and arranged to provide an attachment point for the attachment of an anchor line, said shank means being adapted such that the anchor provides a line direction from the centroid of the fluke to said attachment point whereby, in relation to a forward edge-wise direction of the fluke member measured in a fore-and-aft plane of symmetry of the anchor, the line direction forms a forward-opening angle with said forward direction of the fluke member whereby a dragging force applied to the anchor at said attachment point by means of the anchor line when said anchor is placed on a sea bed surface causes embedment of the anchor by penetrative movement into the soil of the sea bed substantially in said forward edgewise direction of the fluke member. Such an anchor and its embedment means will hereinafter be referred to as an embedment anchor and its embedment means as hereinbefore described.

A direct embedment anchor, in contrast, is embedded by pushing the anchor into a mooring bed vertically or inclined to the vertical by the use of embedment means comprising a pushing follower member or comprising momentum developed, for example, gravitationally, hydraulically, or explosively. The direct embedment anchor comprises a planar or curved plate-like or blade-like fluke member adapted for accommodating said embedment means and arranged to provide an attachment point for the attachment of an anchor line thereto, said anchor possessing a direction of minimum projected area wherein resistance to penetration of the anchor in a mooring bed soil is minimal, said attachment means providing an attachment point for said anchor line locatable such that a pulling force in the anchor line tends to cause movement of the anchor substantially at right angles to said direction of minimum projected area. Such an anchor and its embedment means will hereinafter be referred to as an embedment anchor and its embedment means as hereinbefore described.

Marine anchors are usually made of steel and often are coated with paint for corrosion protection. Such a coating, being softer than steel, is vulnerable to abrasive removal by hard particles in a sea bed soil ploughing a series of grooves therein which result cumulatively in removal of the coating. This abrasive action increases the range of the coefficient of friction of the coated anchor relative to the material of the sea bed soil particles sliding submerged thereon beyond the usual 0.3 to 0.6 range occurring for an uncoated anchor. The concomitant increase in friction force on the coated anchor increases its resistance to dragging when buried in sea bed soil and so increases its holding capacity but this enhanced holding capacity decreases again to that of an uncoated anchor as the coating is stripped off by abrasion. Thus, other avenues for increasing the holding capacity of anchors have occupied the attention of designers in the past.

Increases in holding capacity of drag embedment anchors have been obtained due to maximisation of fluke area, development of stabilisation means, optimal selection of forward-opening angle to suit particular soils, minimisation of anchor line diameter, and streamlining to avoid stalling of soil flow over the anchor whilst ensuring that the pull applied by the anchor line at the sea bed surface is as close to horizontal as possible.

Increases in the holding capacity of direct embedment anchors have been obtained by maximisation of fluke area, streamlining, minimisation of anchor line diameter, and reduction of said minimum projected area.

It has generally been established that the forward-opening angle of a drag embedment anchor requires to be of a particular magnitude to suit a particular sea bed soil. Thus, a drag embedment anchor may provide maximum holding capacity in sand if the onward opening angle is approximately 45° and maximum holding capacity in soft clay if it is approximately 65°. Beyond these values of forward-opening angle, the holding capacity decreases progressively until the drag embedment anchor fluke ultimately backs out of the sea bed soil after initial penetration. However, when the forward-opening angle is set at 65° for soft clay, negligible holding capacity is obtained in sand. When set at 45° for sand, very low holding capacity is obtained in soft clay. No intermediate angle has been found to provide optimum performance in both sand and soft clay. Although compromise angles in the range 50° to 56° have been used in the past, performance within acceptable deviations from the optima for sand and soft clay has not been realised. The selection of a forward-opening angle to achieve acceptable capacity in a particular soil thus reduces the versatility of the drag embedment anchor for use in a wide variety of soils.

The objectives of the present invention include inter alia increasing the versatility of drag embedment anchors and decreasing the penetration resistance of both drag embedment and direct embedment anchors and their embedment means as hereinbefore described.

According to one aspect of the present invention, an anchor and its embedment means as hereinbefore described is characterised in that at least one of the anchor and its embedment means includes a low friction external surface. In particular, this external surface will have a lower value of coefficient of friction relative to sea bed soil particles sliding submerged thereon than occurs similarly on the external surfaces (usually steel or painted steel) presently known on marine anchors.

Preferably said external surface is formed of a low friction material.

Preferably said external surface is formed of a coating of solid low friction lubricating material adhering to the anchor.

Preferably said coating comprises a layer formed of at least one of the substances polytetrafluoroethylene, ethylene-chlorotrifluoroethylene copolymer, graphite, and diamond, with diamond most preferred.

Preferably said coating comprises a layer formed by at least one of a fluid lubricant and a semi-solid grease-like lubricant.

Preferably said fluid lubricant is at least one of water and a vegetable oil.

Preferably said vegetable oil is at least one of olive oil, rapeseed oil, sunflower oil, coconut oil, and palm oil.

Preferably at least one of said coating, low friction material, and said lubricant includes a hydrophobic substance which prevents adhesion of sea bed soil on a external surface of said anchor.

Preferably said hydrophobic substance comprises a silicone material.

Preferably said lubricant is pumpable and smearable to form said coating.

Preferably said lubricant is at least one of biodegradable and short-term degradable.

Preferably said lubricant contains a delayed-action inhibiting substance whereby the lubricity of the lubricant is considerably reduced after a determinable period of time.

Preferably said low friction external surface comprises a lubricated surface.

Preferably said coefficient of friction of said external surface with respect to sea bed soil particles (e.g. sand) sliding submerged thereon does not exceed 0.27 and, further preferably, does not exceed 0.2.

Preferably said low friction external surface is located on at least one of the anchor fluke and the anchor shank and the anchor embedment means.

Preferably at least one of said anchor and said anchor embedment means includes replenishment means for replenishing loss of lubricant material from said external surface due to entrainment with sea bed soil sliding therefrom.

Preferably said lubricant is delivered via a closed channel to said external surface on which a layer of lubricant is thereby maintained by entrainment with sea bed soil sliding thereon.

Preferably a plurality of outlets for lubricant is located adjacent to and spaced along a forward edge of said external surface.

Preferably said lubricant replenishment means includes a container of lubricant material acting as a supply reservoir.

Preferably said reservoir is drained by a pump operable by movement of sea bed soil relative to said external surface whereby said lubricant contained in said reservoir is metered proportional to motional displacement of said anchor in the sea bed soil for delivery to said forward edge of said external surface as the anchor and embedment means penetrates into the sea bed.

According to another aspect of the present invention, an apparatus is provided for attachment to at least one of an anchor and its embedment means as hereinbefore described characterised in that the apparatus includes delivery means for delivering a lubricant to an external surface of at least one of said anchor and its embedment means whereby a layer of said lubricant may be established on said surface by entrainment with sea bed soil sliding thereon.

Preferably said apparatus includes reservoir means containing said lubricant and pump means to pump lubricant from said reservoir means to said external surface.

Preferably said apparatus includes metering means whereby said lubricant is metered for delivery to said external surface proportionate to motional displacement of said surface in said sea bed soil.

Preferably said pump means and said metering means comprises a soil turbine having blades rotatable by soil impingement thereon and connected by means of a driving shaft to a pump whereby pumping of said lubricant from said reservoir to said external surface occurs in proportion to soil movement relative to said apparatus.

Preferably said means of delivering said lubricant comprises a closed conduit channel attached to a forward edge of said external surface and perforated with holes spaced along said edge from which said lubricant may escape to become smeared over said external surface by entrainment with sea bed soil sliding thereon.

Preferably said reservoir means comprises a flexible pillow tank.

Preferably said apparatus for a drag embedment anchor includes differential delivery means for delivering lubricant differentially to a port and starboard pair of external surfaces on said anchor.

Preferably said differential delivery means comprises a pendulum-controlled valve which reduces lubricant flow to a lowermost one of said port and starboard pair of external surfaces when said anchor is tilting transversely due to rolling with concomitant yawing whereby frictional forces are reinstated such as to oppose said yawing and thus said tilting.

Preferably a drag embedment anchor includes at least one of said low friction surface and said lubrication means and has a forward-opening angle $\beta$ exceeding 66° for use in soft clay and exceeding 46° for use in sand.

Preferably said angle $\beta$ is in the range 68° to 80° for soft clay and 50° to 68° for sand, with the range 70° to 77° for soft clay and 56° to 64° for sand further preferred.

Preferably a drag embedment anchor for use in both sand and soft clay soils includes at least one of said low friction surface and said lubrication means and has a forward-opening angle $\beta$ in the range 54° to 64° with the range 58° to 62° further preferred.

Preferably a direct embedment anchor and its embedment means as hereinbefore described includes at least one of said low friction surface and said lubrication means.

Embodiments of the present invention will now be described by way of example with reference to the accompanying drawings wherein:

FIG. 4 shows the anchor of FIG. 1 viewed in direction D and fitted with apparatus according to the present invention;

FIG. 5 shows a front elevation view of the soil turbine and pump shown in FIG. 4;

FIG. 6 shows a part section AA of the fluke of the anchor of FIG. 4 to a larger scale;

FIG. 7 shows a part section BB of the shank of the anchor of FIG. 4 to a larger scale;

Figure 1:
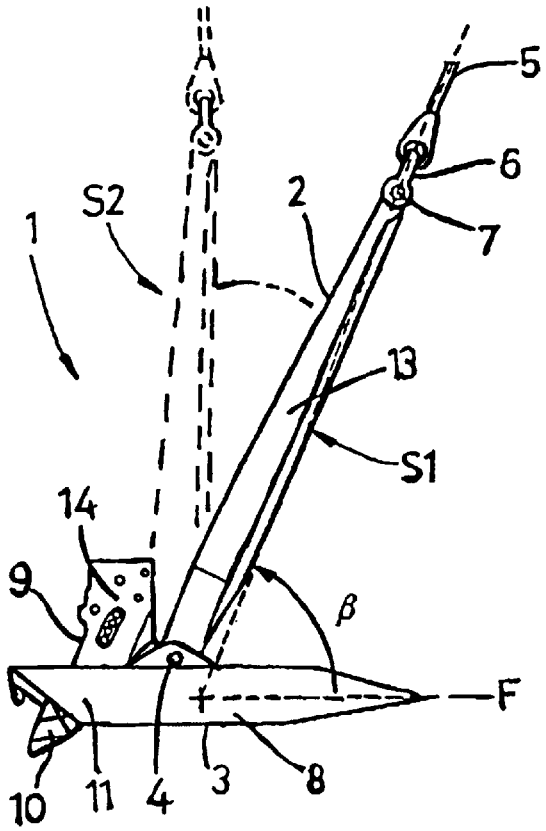
FIG. 1 shows a side elevation view of a drag embedment anchor and its embedment means according to the present invention.
Figure 2:
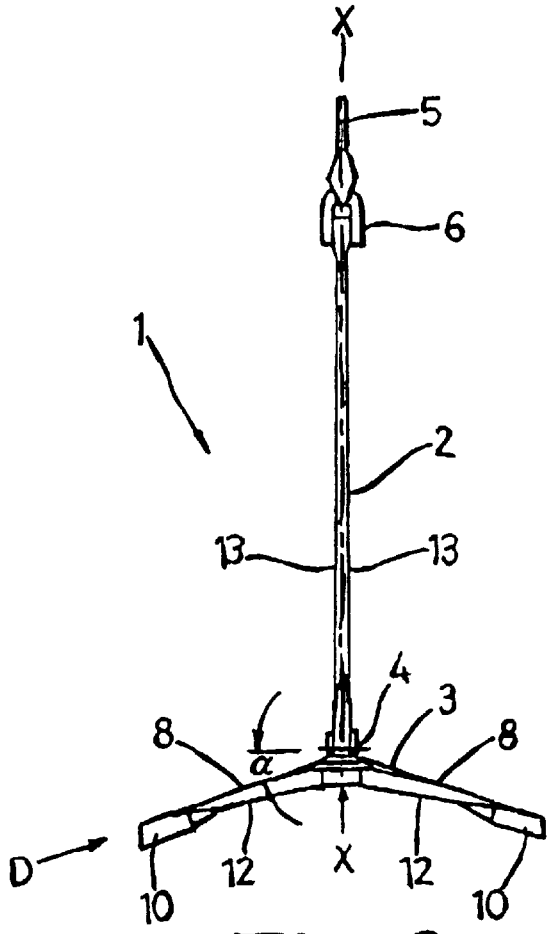
FIG. 2 shows a front elevation view of the anchor of FIG. 1.
Figure 3:
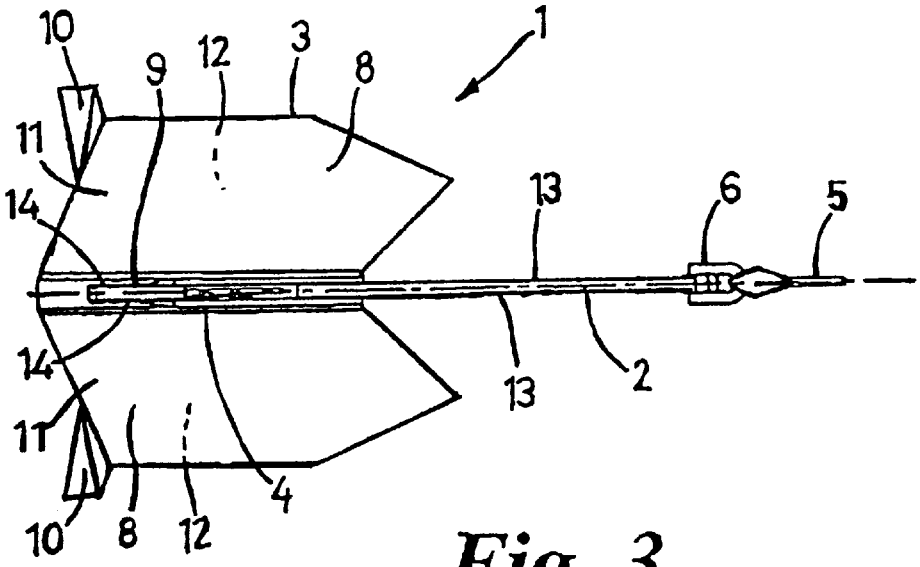
FIG. 3 shows a plan view of the anchor of FIG. 1.

In a first embodiment of the present invention, a drag embedment anchor 1 (FIGS. 1 to 3) for drag embedment in a mooring bed soil comprises a shank 2 pivotably connected at one end to a plate-like or blade-like fluke 3 by means of pin 4 and at the other end to an anchor line 5 by means of a shackle 6 pivotably pinned in hole 7 in shank 2. Fluke 3 is of anhedral form and anchor 1 is symmetrical about a plane X—X (FIG. 2). The upper surfaces 8 of fluke 3 are planar with an anhedral angle $\alpha$ of 20° at each side of the plane of symmetry X—X. A line in plane X—X joining the centre of shackle hole 7 and centroid C of the upper surfaces of fluke 3 forms a forward-opening angle $\beta$ with a forward direction F (FIG. 1) of fluke 3. The angle $\beta$ exceeds 65° when the anchor is used in soft clay and exceeds 45° when used in sand. The angle β is generally set in the range 66° to 80° for soft clay and 46° to 68° for sand. The forward direction F is parallel to the intercept of the planes of surfaces 8 in the plane of symmetry X—X and defines substantially the general direction of edge-wise movement of fluke 3 in sea bed soil when the anchor 1 is dragged therein. Locking mechanism housing 9 contains a mechanism for locking shank 2 with respect to fluke 3 at a particular selectable forward-opening angle β. The mechanism within the housing 9 is actuable to permit movement of the shank from a setting shown at S1 in FIG. 1 providing a forward opening angle β within the range as above specified for burial of the anchor for drag embedment to a setting S2 (shown dashed) wherein the shank 2 is substantially at right angle to the fluke 3 and defining the mooring setting of the anchor wherein the mooring force is applied via cable 5 substantially normal to the fluke 3. Where the anchor 1 has a fixed setting of the shank 2 as at S1, the forward opening angle β preferably lies in the range 54° to 64° with the range 58° to 62° especially preferred, and this will enable the anchor to be usable in both sand and soft clay sea bed soils.

Stabilisers 10 are attached to rear portions 11 of fluke 3 spaced from each side of the plane of symmetry X—X. Fluke 3 has upper and lower external surfaces 8 and 12 respectively whilst shank 2 has external side surfaces 13. Locking mechanism housing 9 has external side surfaces 14. These external surfaces 8, 12, 13, and 14, together with the external surfaces of stabilisers 10, are coated with a low-friction material comprising at least one of polytetrafluoroethylene, ethylene-chlorotrifluoroethylene copolymer, graphite, diamond or the like. In the event of the low friction coating being rendered ineffective by being hydrophilic and thereby allowing a sea bed soil to develop an adhesion thereto in excess of the shear strength of the soil, a hydrophobic substance (for example, a silicone material) is included in the coating to prevent such adhesion. The low friction coating ensures that the coefficient of friction relative to sea bed soil particles sliding submerged thereon is less than the coefficient of friction that would occur similarly on a bare or painted steel surface. The resulting reduced coefficient of friction, in turn, ensures that the frictional forces on anchor 1 resisting penetration into sea bed soil are reduced.

As previously stated, sea bed soils contain abrasive particles which progressively remove the abovementioned abradable low-friction materials as anchor 1 penetrates under the sea bed surface. In some sea bed soils, substantial abrasive removal of the softer coatings may occur before a desired depth of penetration of anchor 1 below the sea bed surface has occurred. This can result in the reappearance of unmitigated frictional forces which can prevent anchor 1 from reaching the desired depth of penetration.

In a second embodiment of the present invention (FIGS. 4 to 7) a solution is provided for the problem of abrasive removal of the low friction coating: anchor 1 is fitted with apparatus 15 (FIG. 4) which replenishes the low-friction coating as it is removed by abrasive sea bed soil siding over the external surfaces of the anchor.

Apparatus 15 comprises a reservoir 16, attached to the rear of underside surface 12 of fluke 3, containing a fluid lubricant 17, connected by a conduit pipe 18 to the inlet of a rotary fluid pump 19 driven by a soil turbine 20 via shaft 21. Fluid pump 19 (FIGS. 4 and 5) is mounted on strut 22 attached forwardly on underside surface 12 of fluke 3. Impingement of sea bed soil on turbine 20 causes it to rotate shaft 21 to drive pump 19 as anchor 1 moves in the sea bed soil. The outlet of fluid pump 19 is connected by a first conduit pipe 23 to a twin-output port pendulum-controlled valve 19A fixed to the underside of fluke 3 which directs lubricant equally to each output port only if anchor 1 is in a vertical orientation with shank 2 lying in a vertical plane. The output ports of valve 19A are connected by pipes 23P, 23S, to thick-wall tubes 24P, 24S, axially aligned parallel with and attached to port (P) and starboard (S) forward edges 25P, 25S, respectively of fluke 3. The outlet of fluid pump 19 is, additionally, connected by a second (partly flexible) conduit pipe 26 to thick-wall tube 27 axially aligned parallel with and attached to the forward edge 28 of shank 2. The thick-wall tubes 24P, 24S, and 27 have sealed ends 29 and are perforated with pin-holes 30 which are in diametrically opposed pairs spaced longitudinally along each thick-wall tube whereby lubricant 17 pumped internally therein by pump 19 can escape at each side of each thick-wall tube along the lengths of forward edges 25P, 25S, and 28 of fluke 3 and shank 2 respectively (FIGS. 6 and 7).

When drag embedment anchor 1 is moving in the sea bed soil with shank 2 lying in a vertical plane, lubricant 17 escaping from pin holes 30 becomes entrained with the soil and spreads over surfaces 8, 12, 13, and 14 thus reducing the friction forces thereon for the duration of supply of lubricant 17 from reservoir 16. Reservoir 16 has sufficient capacity to permit full lubrication of surfaces 18, 12, 13 and 14 until the desired penetration of anchor 1 below the sea bed surface has been achieved. A portion of the external surfaces on anchor line 5 may also be supplied with lubricant 17 in a like manner. Due to the very small size of the holes 30 and the high fluid pressure produced by pump 19, blockage of the holes 30 by soil material is substantially precluded.

If anchor 1 rolls and, concomitantly, yaws to bring shank 2 out of a vertical plane, pendulum-controlled valve 19A acts to reduce lubricant supply to the lowermost of thick-walled tubes 24P and 24S whereby friction forces are increased on the lowermost side of fluke 3 due to lubricant, starvation. This causes anchor 1 to tend to turn in the opposite direction to the roll-induced yawing. This effect may be enhanced by differentially lubricating the eternal surfaces of stabilisers 10 in a similar manner. Thus, differential supply of lubricant to appropriate surfaces can provide automatic control of roll and yaw in anchor 1.

Reservoir 16 is conveniently formed by a pillow tank made of flexible sheet material secured by clamps to the rear of underside surface 12 of fluke 3. Lubricant 17 thus is subjected to the same pressure that occurs externally to reservoir 16 so that no pressure differential exists across the flexible sheet material. Reservoir 16 can, therefore, be of light construction. Since fluid pump 19 is driven by soil turbine 20 via shaft 21, the delivery rate of lubricant 17 to the external surfaces of anchor 1 is proportional to anchor displacement in the sea bed soil.

The lubricant volume pumped per unit length of anchor movement is chosen to maintain a constant film thickness of lubricant 17 on the said external surfaces. Thus, a reservoir fluid capacity of 13 liters maintains a 0.1 mm thick layer of lubricant on the external surfaces of a $10m^2$ fluke area anchor 1 (total lubricated area of $26m^2$) over a penetration trajectory length of 50m despite entrainment loss of lubricant to the passing soil. An appropriately specified lubricant can reduce the coefficient of friction in the range 0.3 to 0.6 to as low as 0.05 and thus can reduce friction force by a factor of up to 12 depending on soil type.

The maximum depth of penetration in a sea bed soil of a drag embedment anchor is a function of the forward-opening angle, the diameter of the embedded portion of the anchor line, the uplift angle of the anchor line to the horizontal at the sea bed surface, and the shear strength of the soil. The penetration trajectory follows a curved path which ultimately becomes horizontal at the maximum depth of penetration. If the friction force generated by sea bed soil sliding on the external surfaces of the anchor is reduced by the use of a low friction hydrophobic lubricant, a reduction in line tension during installation to reach a given depth of penetration on the trajectory is realised. The shape of the trajectory itself however is not affected by the value of the friction force.

A drag embedment anchor of the type disclosed in the above mentioned International Patent Applications benefits from this reduction of line tension during installation. Such an anchor is loaded at 90° to the fluke after completion of drag embedment by increasing the forward-opening angle β to 90° (FIG. 1). The pull-out capacity of the anchor when loaded at 90° to the fluke is not significantly affected by the presence of the lubricant. However, the ratio of pull-out capacity to (lubricant-reduced) installation tension in anchor line 5 is increased. In particular, the ratio of pull-out capacity to the horizontal component of tension in anchor line 5 can be increased by 50 per cent or more in soft clay soils by the use of the low friction hydrophobic coating on anchor 1. Thus, the bollard pull required from an anchor installation vessel may be substantially reduced and installation costs thereby greatly diminished.

Since lubrication of a drag embedment anchor reduces line tension at all points on the penetration trajectory, the holding capacity of the anchor is reduced. Lubrication of a drag embedment anchor may therefore, be regarded as a retrograde step. However it has been found that higher holding capacities may be obtained in sands and so clays when the external surfaces of an anchor are coated with a lubricant to permit a larger value of forward-opening angle to be adopted than that known in the past to be the limiting value after which penetration and holding capacity decreases precipitately in a particular soil.

This limiting value is inversely related to the magnitude of the friction force developed by sea bed soil particles sliding on the surfaces of the anchor. Any reduction of friction force due to lubrication permits an increase in the limiting value of the forward-opening angle. Thus, a larger maximum penetration depth and consequently higher holding capacity can be obtained by adopting a larger forward-opening angle than hitherto possible in an unlubricated drag embedment anchor notwithstanding the reduction in anchor line tension at a given depth of penetration that is due to using a lubricant.

The quantity of lubricant 17 in reservoir 16 may be chosen so that it becomes exhausted at a particular point on the penetration trajectory of drag embedment anchor 1. Beyond this point, the functional forces on the anchor are thus fully restored and a large increase in holding capacity is obtained at a penetration depth unachievable without lubrication.

The lubricant 17 is chosen, furthermore, to be environmentally acceptable or biodegradable or short-term degradable. Thus, a vegetable oil such as olive oil, rapeseed oil, sunflower oil, coconut oil or palm oil may be used in both sand and clay soils. Also, a delayed action inhibiting substance, serving to nullify the lubricity of the lubricant after a determinable period of time, may be included in the lubricant and added to it at pump 19 from a separate reservoir. Such choice or modification of the lubricant avoids the creation of permanently lubricated slip planes in the sea bed soil behind the anchor and also increases the holding capacity of the drag embedment anchor shortly after completion of installation to a given depth below the sea bed surface by restoration of friction forces.

Further, the coating of lubricant permits a drag embedment anchor to penetrate into sand at a large value of forward-opening angle hitherto useable only in soft clay. A lubricated anchor with a single forward-opening angle in the range 56° to 64° and particularly in the range of 58° to 62° will provide a performance within acceptable deviations from the optima for sand and soft clay when used in either type of soil thus providing a valuable increase in anchor versatility.

Additionally, the lubricant coated drag embedment anchor exhibits an ability to penetrate through alternating layers of sand and soft clay without the fluke becoming trapped at an interface between sand and underlying soft clay. This capability has not been present in drag embedment anchors in the past although a proposal is disclosed in the applicants co-pending International Patent Application No. PCT/GB98/00109 filed Jan. 22, 1998 entitled "Marine Anchor." (To be published as WO In a third embodiment of the present invention, a direct embedment anchor 1A (FIG. 8). for edgewise embedment into a mooring bed in a vertical direction comprises the anchor of FIGS. 1–7 modified by having the stabilisers 10 deleted and the shank 2A considerably reduced in length. All other aspects of anchor 1A of FIG. 4 are identical with anchor 1 of FIGS. 1–7 and carry like numerical references.

Figure 8:
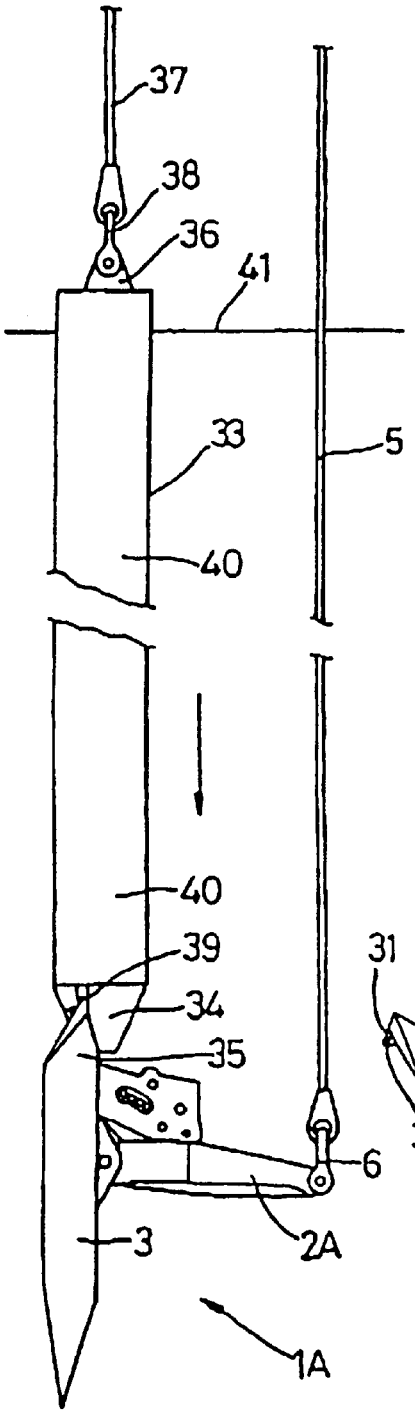
FIG. 8 shows a side elevation view of a direct embedment anchor and its embedment means according to the present invention.
Figure 9:
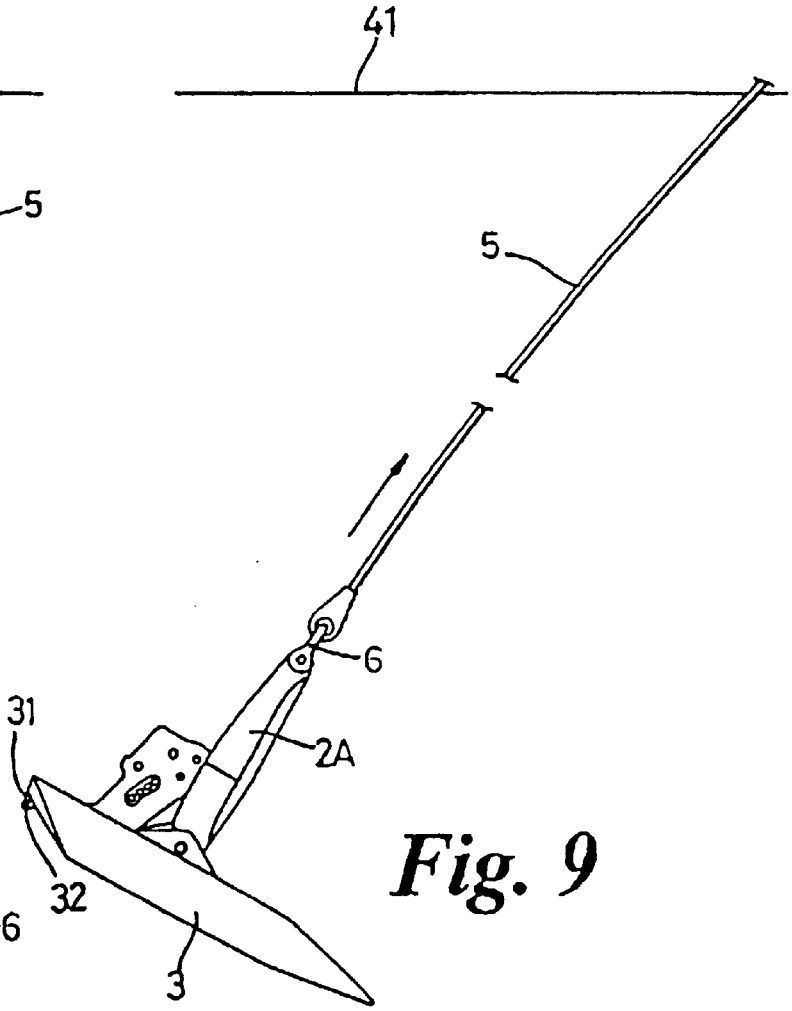
FIG. 9 shows the anchor of FIG. 8 in a final attitude after pulling on its cable following removal of its embedment means.

A heavy elongate cylindrical follower 33 serves as a rigid pushing member for driving anchor 1A vertically into a seabed by its weight. Follower 33 (FIG. 8) has a conical clevis 34 at a lower end which accommodates a rear portion 35 of fluke 3 of anchor 1A. A lug 36 is present at an upper end of follower 33 for connection to lowering and raising line 37 by means of shackle 38. A shearable release pin 39 in clevis 34 passes through hole 32 in lug 31 on fluke 3 (FIGS. 5 and 9) and serves to hold fluke 3 in clevis 34 during lowering of the anchor and follower to the seabed but which breaks due to soil resistance to free anchor 1A from follower 33 to allow recovery of follower 33 after completion of embedment of anchor 1A. The embedment operation is accomplished by lowering the anchor 1A and follower 33 onto the sea bed by means of line 37 paid out from one winch on a single anchor handling vessel (AHV) with anchor line 5 being paid out slack in step by another winch on the AHV. Paying out of the lines is continued and tension in line 37 decreases progressively as soil penetration resistance supports an increasing portion of the submerged weight of anchor 1A and follower 33 and relieves tension in line 37. When soil penetration resistance supports the whole of the submerged weight of anchor 1A and follower 33, line 37 goes slack and embedment of anchor 1A is completed. Follower 33 is withdrawn from fluke 3 of anchor 1A and from the sea bed by heaving up on line 37. Rotation of anchor 1A to bring fluke 3 at right angles to the load applied by anchor line 5 is then accomplished simply by pulling on line 5 (FIG. 9) whereby anchor 1A achieves a maximum pullout capacity. Follower 33 includes low friction external surfaces 40 and anchor 1A includes low friction surfaces as previously described for anchor 1. The presence of the low friction surfaces in general, and the delivered lubricant in particular, on anchor 1A and follower 33 greatly reduces the penetration resistance encountered in embedding anchor 1A to a given depth below the seabed surface 41 (FIG. 8). Consequently, the required weight of follower 33 is sufficiently reduced that embedment by weight alone, without recourse to the use of a pile-driving hammer on the follower as commonly practiced throughout the present century. For example, a comparison of unlubricated and lubricated 0.86m diameter followers necessary to instal a 700 tonne pullout capacity direct embedment anchor of $12m^2$ fluke area and 8 tonnes weight (FIG. 8), with a load safety factor of 1.25, in normally consolidated clay with a shear strength gradient of 1.6KPa/m and a sensitivity of 2 reveals the following:

| | Unlubricated | Lubricated |
|---|---|---|
| Weight of follower | 356 tonnes | 141 tonnes |
| Length of follower | 78 meters | 31 meters |
| Force to retrieve follower | 409 tonnes | 147 tonnes |

Clearly, lubrication of the surfaces of a direct embedment anchor and its follower makes a very large difference to the weights and forces involved in the installation operation. In the unlubricated case, the excessive length and weight of the follower makes direct embedment of the anchor impracticable and the force to retrieve it is beyond the capacity of the winches on almost all of the anchor handling vessels presently available in the world.

Modifications of the construction details of the present invention are, of course, possible. In particular, the lubricant reservoir may comprise a metal cylinder containing a piston actuated by a spring or a gas to provide pressurisation of the lubricant and it may be attached to the anchor line 5 above the sea bed surface or even be located on the anchor installation vessel and the apparatus on the anchor supplied by a tube attached along the length of anchor line from reservoir to anchor. Further, the anchor included in the invention may have a shank formed by a plurality of wire ropes and a fluke of a different shape from that shown in FIGS. 1–4. Surfaces 13 would then be present on each of the wire ropes comprising the shank.

What is claimed is:

1. A marine anchoring device adapted to penetrate into sea bed soil, characterized in that the anchoring device comprises a low friction external surface having a coefficient of friction relative to submerged sea bed soil particles sliding thereon less than the comparable coefficient of friction for bare water-coated and painted steel surfaces.

2. An anchoring device as claimed in claim 1, characterized in that said external surface is formed of a low friction material.

3. An anchoring device as claimed in claim 2, characterized in that said external surface is formed of a coating of solid low friction lubricating material adhering to the device.

4. An anchoring device as claimed in claim 3, characterized in that said coating comprises a layer formed of at least one of the substances polytetrafluoroethylene, ethylene-chlorotrifluoroethylene copolymer, graphite and diamond.

5. An anchoring device as claimed in claim 2 characterized in that said external surface is formed by at least one of a fluid lubricant and a semi-solid grease-like lubricant.

6. An anchoring device as claimed in claim 5, characterized in that said fluid lubricant is a vegetable based oil.

7. An anchoring device as claimed in claim 6, characterized in that the vegetable based oil comprises any one of olive oil, rapeseed oil, sunflower oil, coconut oil and palm oil.

8. An anchoring device as claimed in claim 5, characterized in that said lubricant is pumpable and smearable.

9. An anchoring device as claimed in claim 5, characterized in that said lubricant is at least one of biodegradable and short-term degradable.

10. An anchoring device as claimed in claim 9, characterized in that said lubricant contains a delayed-action inhibiting substance whereby the lubricity of the lubricant is nullified after a determinable period of time.

11. An anchoring device as claimed in claim 5, wherein said anchoring device comprises an anchor having an anchor fluke connected to an anchor shaft and an anchor embedment means associated therewith, characterized in that said low friction external surface is located on at least one of the anchor fluke and the anchor shank of the anchor and said anchor embediment means.

12. An anchoring device as claimed in claim 11, characterized in that at least one of said anchor and said anchor embedment means comprise replenishment means for replenishing loss of lubricant material from said external surface due to entrainment of the lubricant material with sea bed soil sliding on the surface.

13. An anchoring device as claimed in claim 12, characterized in that said lubricant is delivered via a closed channel to said external surface on which a layer of lubricant is thereby maintained by entrainment with sea bed soil sliding on the surface.

14. An anchoring device as claimed in claim 12, characterized in that said lubricant is delivered via a closed channel to a forward edge of the external surface on at least one of a fluke of the anchor and a shank of the anchor on which a layer of lubricant is thereby maintained by entrainment with sea bed soil sliding thereon.

15. An anchoring device as claimed in claim 14, characterized in that a plurality of outlets for lubricant is located at and spaced along said forward edge of said external surface.

16. An anchoring device as claimed in claim 5, wherein said anchoring device comprises an anchor having an anchor fluke connected to an anchor shaft and an anchor embedment means associated therewith, characterized in that said low friction external surface is located on at least one of the anchor fluke and the anchor shank of the anchor and said anchor embedment means.

17. An anchoring device as claimed in claim 16, characterized in that said reservoir is drained by a pump means operable by movement of sea bed soil relative to said anchor whereby said lubricant contained in said reservoir is metered proportional to anchor motional displacement in the sea bed soil for delivery to said forward edge of said external surface as the anchor penetrates into the sea bed.

18. An anchoring device as claimed in claim 2, characterized in that said low friction material comprises at least one of a coating of low friction material, and a lubricant and comprises a hydrophobic substance which prevents adhesion of sea bed soil on said external surface of the device.

19. An anchoring device as claimed in claim 18, characterized in that said hydrophobic substance comprises a silicone material.

20. An anchoring device as claimed in claim 1, characterized in that the low friction external surface substantially loses its low friction characteristic at the end of a period during the act of deploying the device.

21. An anchoring device as claimed in claim 1, characterized in that said low friction external surface comprises a lubricated surface.

22. An anchoring device as claimed in claim 1, characterized in that said coefficient of friction of said external surface with respect to sand, sliding thereon does not exceed 0.2.

23. An anchoring device as claimed in claim 1, and comprising an anchor characterized in that the anchor comprises means for adjusting the setting of the anchor fluke relative to the anchor shank whereby in an operative position of the anchor in a sea bed soil the shank is set relative to the fluke so that the pull on the anchor via an anchor cable is substantially normal to the upper surface of the fluke.

24. An anchoring device as claimed in claim 1 and in the form of a drag embedment anchor, characterized in that the anchor has a forward opening angle β exceeding 66° for use in soft clay.

25. A drag embedment anchor as claimed in claim 24, characterized in that said angle β is in the range 68° to 80° for soft clay and 50° to 68° for sand.

26. An anchoring device as claimed in claim 1, and in the form of a drag embedment anchor with a fixed shank and for use in both sand and soft clay soils, characterized in that the anchor has a forward-opening angle β in the range 54° to 64°.

27. An anchoring device as claimed in claim 24 or claim 26, characterized in that said apparatus includes metering means whereby said lubricant is metered for delivery to said external surface proportionate to motional displacement of said anchor in said sea bed soil.

28. An anchoring device as claimed in claim 1 comprising a direct embodiment anchor and an elongate pushing member embedment means.

29. An anchoring device as claimed in claim 28 and comprising a lubricant supply apparatus attached to at least one of said direct embedment anchor and said elongate pushing member embedment means, said lubricant supply apparatus comprising delivery means for delivering a lubricant to an external surface of at least one of said anchor and said embedment means whereby a layer of said lubricant is established on said surface by entrainment with sea bed soil sliding thereon.

30. A lubricant supply apparatus for attachment to at least one of an anchor, and an anchor embedment means characterized in that the apparatus comprises delivery means for delivering a lubricant to an external surface of at least one of said anchor and the embedment means whereby a layer of said lubricant is established on said surface by entrainment with sea bed soil sliding thereon.

31. A lubricant supply apparatus as claimed in claim 30, characterized in that said apparatus comprises reservoir means containing said lubricant, and pump means to pump lubricant from said reservoir means to said external surface.

32. An apparatus as claimed in claim 31, characterized in that said reservoir means comprises a flexible pillow tank.

33. A lubricant supply apparatus as claimed in claim 30, characterized in that said apparatus comprises a soil turbine having blades rotatable by soil impingement thereon and connected by means of a driving shaft to said pump means whereby pumping of said lubricant occurs in proportion to soil movement relative to said anchor.

34. An apparatus claimed in claim 30, characterized in that said means for delivering said lubricant comprises a closed conduit channel attached to and aligned with a forward edge of said external surface and perforated with holes spaced along said edge from which said lubricant may escape to become smeared over said external surface by entrainment with sea bed soil sliding thereon.

35. An apparatus as claimed in claim 30, characterized in that there is provided differential delivery means for delivering lubricant differentially to a port and starboard pair of external surfaces on said anchor.

36. An apparatus as claimed in claim 35, characterized in that said differential delivery means comprises a pendulum-controlled valve which reduces lubricant flow to a lowermost one of said port and starboard pair of external surfaces when said anchor is tilting transversely due to rolling with concomitant yawing whereby frictional forces are reinstated such as to oppose said yawing and thus said tilting.

37. A drag embedment anchor including a lubricant supply apparatus as claimed in claim 30, characterized in that the anchor has a forward opening angle β exceeding 66° for use in soft clay.

38. A drag embedment anchor with a fixed shank for use in both sand and soft clay soils and comprising the lubricant supply apparatus of claim 30, characterized in that the anchor has a forward-opening angle β in the range 54° to 64°.

39. A method of deploying an anchor by means of an anchor embedment means comprising an elongate pushing member, said anchor comprising a fluke and a shank attached to the fluke, said method being characterized by steps comprising:

a. applying a low friction surface to any one of said anchor and the pushing member;

b. causing the anchor to be carried by the pushing member by a carrying device on the pushing member, so as to form a combination comprising the anchor and the pushing member;

c. fitting a support cable to the pushing member for lowering of said combination towards the sea bed wherein the anchor is to be deployed, and fitting an anchor cable to the shank of the anchor;

d. controlled lowering of the combination to a contact position on the sea bed surface;

e. causing the pushing member by means of its weight to directly embed the anchor into the sea bed from said contact position;

f. releasing the embedded anchor from the pushing member;

g. adjusting the anchor so that the anchor is set in an operating position in the sea bed for mooring a body at the sea surface by means of the anchor cable; and h. retrieving the pushing member from the seabed by means of said support cable.

40. A method as claimed in claim 39, characterized in that anchor deployment is effected by a single anchor handling vessel at the sea surface, the support cable and the anchor cable being run out from this vessel during the controlled lowering step of the combination.

41. A method as claimed in claim 39, characterized in that in the operating position of the anchor the pull on the anchor cable is substantially normal to the fluke of the anchor.

* * * * *